US005236526A

United States Patent [19]

Perotto

[11] Patent Number: 5,236,526

[45] Date of Patent: Aug. 17, 1993

[54] PYROTECHNIC COMPOSITION GENERATING NONTOXIC GASES, COMPRISING AN INORGANIC BINDER

[75] Inventor: Christian Perotto, Ballancourt, France

[73] Assignee: S.N.C. Livbag, Vert le Petit, France

[21] Appl. No.: 720,628

[22] Filed: Jun. 25, 1991

[30] Foreign Application Priority Data

Jun. 27, 1990 [FR] France ..... 90 08096

[51] Int. Cl.[5] ..... C06B 45/06

[52] U.S. Cl. ..... 149/17; 149/35

[58] Field of Search ..... 149/17, 35

[56] References Cited

U.S. PATENT DOCUMENTS

| | | | |
|---|---|---|---|
| 3,920,575 | 11/1975 | Shiki et al. | 149/35 |
| 4,021,275 | 5/1977 | Kishi et al. | 149/35 |
| 4,203,787 | 5/1980 | Kirchoff et al. | 149/35 |
| 4,349,386 | 9/1982 | Davidovits | 106/85 |
| 4,472,199 | 9/1984 | Davidovits | 106/85 |
| 4,533,416 | 8/1985 | Poole | 149/35 |
| 4,758,287 | 7/1988 | Pietz | 149/35 |
| 4,920,743 | 5/1990 | Cartwright | 149/35 |
| 4,931,111 | 6/1990 | Poole et al. | 149/35 |
| 5,074,940 | 12/1991 | Ochi et al. | 149/35 |
| 5,089,069 | 2/1992 | Ramasamy et al. | 149/35 |
| 5,143,567 | 9/1992 | Taylor et al. | 149/35 |

*Primary Examiner*—Edward A. Miller

*Attorney, Agent, or Firm*—Cushman, Darby & Cushman

[57] ABSTRACT

The present invention relates to pyrotechnic compositions generating nontoxic gases intended to inflate, in the event of an accident, the protective cushions for the occupants of a motor vehicle.

The compositions according to the invention contain an azide, an inorganic oxidising agent and, characteristically, between 5% and 40% by weight of an inorganic binder which is the product of an inorganic polycondensation reaction of mixtures based on alkali metal silicoaluminates. The binder is preferably the product of polymerisation of a silicoaluminate of formula ($Si_2O_5$.$Al_2O_2$) and of silica $SiO_2$ in the presence of aqueous sodium hydroxide and/or of aqueous potassium hydroxide.

After the various constituents of the composition have been mixed and formed, the polymerisation of the said binder is ensured in a first stage by heating in a leak-proof closed vessel and the drying of the composition is ensured in a second stage.

The compositions with inorganic binder according to the invention exhibit a mechanical strength and a moisture resistance which are superior to those exhibited by equivalent compositions without binder.

6 Claims, No Drawings

PYROTECHNIC COMPOSITION GENERATING NONTOXIC GASES, COMPRISING AN INORGANIC BINDER

The present invention relates to the field of motor vehicle safety. More precisely, the invention relates to a new pyrotechnic composition generating nontoxic cold gases and to a process for its manufacture. The composition according to the invention can especially be employed in pyrotechnic generators intended for inflating, in the event of an accident, protective cushions for the occupants of a motor vehicle.

It is known to ensure the protection of the occupants of a motor vehicle in the event of an accident by means of inflatable bags or cushions which insert themselves between the body of the occupant of the vehicle and the inner walls of the latter. To be effective, such a bag must be capable of being inflated in a very short time, of the order of at most a few tens of milliseconds; furthermore, the device as a whole, once fitted in a motor vehicle, must remain reliable for a number of years. To satisfy this twin requirement, a solution consists in ensuring the inflation of the bag with the combustion gases of a pyrotechnic composition placed in a gas generator connected, on the one hand, to the said inflatable bag and, on the other hand, to a collision detector.

To satisfy the motor vehicle safety standards the pyrotechnic composition must be capable of burning very quickly and of generating nontoxic gases. A group of pyrotechnic compositions which satisfy these requirements consists of compositions comprising an alkali or alkaline-earth metal azide such as sodium azide and an inorganic oxidizing agent such as an alkali or alkaline-earth metal nitrate, an alkali or alkaline-earth metal perchlorate, a metal oxide, a metal sulphide or even sulphur. Such compositions are described, for example, in U.S. Pat. Nos. 4,369,079, 4,092,190, 4,243,443 or 4,203,787.

However, such compositions exhibit the disadvantage of requiring an efficient filtration chamber in the generator, because, when burning, they release many hot solid particles which are entrained with the combustion gases, but which absolutely must not enter the inflatable bag, in order not to introduce hot spots therein. Furthermore, some of these particles, consisting of sodium oxide, are extremely corrosive.

Attempts have been made to overcome this disadvantage by adding pulverulent silica to the composition, which, at the time of combustion, traps the sodium oxide particles to form a glass. This solution is described, for example, in U.S. Pat. No. 3,947,300. The presence of silica does make it possible to eliminate the problem of sodium oxide particles, but does not eliminate the problems linked with the presence of other solid particles.

Furthermore, all the compositions just described exhibit two disadvantages linked with the nature of their constituents.

On the one hand, the basic constituents, azide, oxidizing agent and possibly silica are employed in pulverulent form. The mixture is agglomerated simply by compression, in general into the form of tablets which are stored away in the combustion chamber. These tablets do not have a good mechanical cohesion and tend to deteriorate with time under the effect of the vibrations transmitted by the motor vehicle. This mechanical deterioration results in a deterioration in the combustion law of the composition.

On the other hand, sodium azide is a moisture-sensitive substance and the generator containing compositions of this type must be protected well against moisture.

With the aim of overcoming these disadvantages attempts have been made to mix the constituents of the azide-based compositions with an organic binder such as a polyurethane or a polyether so as to impart better mechanical behavior to the tablets and to provide the azide with partial protection against moisture. Such a solution is described, for example, in U.S. Pat. No. 3,779,823.

However, a solution of this type remains relatively unsatisfactory insofar as, by introducing carbon and nitrogen atoms, organic binders increase the toxicity of the gases and can be employed only in very small quantities, of the order of a few percent by weight, and this does not enable them to contribute any appreciable improvement from the viewpoint of mechanical behavior and from the viewpoint of protecting the azide against moisture.

The use of azide-based pyrotechnic compositions generating nontoxic cold gases presents, therefore, problems of gas filtration, of mechanical behavior of the compositions and of chemical protection of the azide, which have not been solved satisfactorily at the present time.

The aim of the present invention is to propose azide-based pyrotechnic compositions generating nontoxic cold gases, which exhibit good mechanical behavior, good protection of the azide against moisture, and a decrease in the solid particles emitted during combustion.

The invention relates, therefore, to a solid pyrotechnic composition generating nontoxic gases, comprising at least one alkali or alkaline-earth metal azide, an inorganic oxidizing agent chosen from the group consisting of alkali or alkaline-earth metal nitrates, alkali or alkaline-earth metal perchlorates, metal oxides, metal sulphides and sulphur, characterized in that it contains an inorganic binder which is the product of an inorganic polycondensation reaction of mixtures based on alkali metal silicoaluminates and whose weight content relative to the total weight of the said composition is between 5% and 40%.

According to a preferred alternative form of the invention the said inorganic binder is the product of polymerization of a silicoaluminate of formula ($Si_2O_5$.$Al_2O_2$) and of silica $SiO_2$ in the presence of aqueous sodium hydroxide and/or of aqueous potassium hydroxide.

The invention also relates to a process for the manufacture of the compositions according to the invention, characterized in that, after mixing and forming the various constituents of the composition, the polymerization of the said binder is ensured in a first stage by heating the said constituents in a leakproof closed vessel and in that the drying of the composition is ensured a second stage.

The compositions according to the invention find a preferred application in pyrotechnic generators of nontoxic cold gases intended to inflate, in the event of an accident, inflatable safety bags for the occupants of a motor vehicle.

A detailed description of implementation of the invention is given below.

The invention relates to a solid pyrotechnic composition generating nontoxic cold gases, comprising at least one alkali or alkaline-earth metal azide and an inorganic oxidizing agent. Sodium azide will be advantageously employed as azide. The inorganic oxidizing agent employed may be most of the inorganic oxidizing agents conventionally employed in gas-generating compositions containing an azide and especially alkali or alkaline-earth metal nitrates, alkali or alkaline-earth metal perchlorates, metal oxides, metal sulphides or sulphur. As an inorganic oxidizing agent capable of being employed within the scope of the present invention there may be mentioned particularly potassium nitrate, calcium nitrate, potassium perchlorate, iron oxides, manganese dioxide, nickel oxide and molybdenum sulphide by itself or mixed with sulphur. However, the preferred inorganic oxidizing agents within the scope of the present invention are alkali or alkaline-earth metal nitrates and in particular potassium nitrate.

A composition according to the invention characteristically contains an inorganic binder.

The inorganic binders which can be employed within the scope of the present invention are the product of an inorganic polycondensation reaction of mixtures based on alkali metal silicoaluminates. These inorganic polymers are obtained by polymerization of a mixture of oxides of silicon and of aluminum in the presence of aqueous sodium hydroxide and/or aqueous potassium hydroxide. They are described, for example, with processes for obtaining them, in French patents 2,464,227, 2,489,290 and 2,489,291 or their U.S. Pat. Nos. 4,349,386 and 4,472,199.

The preferred polymers within the scope of the present invention are obtained by polymerization of a silicoaluminate of formula ($Si_2O_5.Al_2O_2$) and of colloidal silica $SiO_2$ in the presence of aqueous sodium hydroxide and/or of aqueous potassium hydroxide. When the ratio of the number of silicon atoms to the number of aluminum atoms is close to 2, they are usually referred to by the name of sodium and/or potassium poly(siloxosialate) and correspond to the following overall formula:

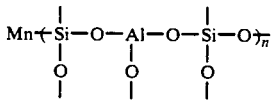

in which:

M denotes a sodium or potassium atom,

Si denotes a silicon atom,

Al denotes an aluminum atom,

O denotes an oxygen atom, n denotes an integer.

The silicoaluminate oxide ($Si_2O_5.Al_2O_2$), which is different from ordinary silicoaluminate ($2SiO_2.Al_2O_2$) is described, for example, in French patent 2,621,260 or in its U.S. Pat. No. 4,859,367.

The compositions according to the invention may contain between 5 and 40% by weight of inorganic binder relative to the total weight of the composition, and preferably between 10% and 30% by weight. By virtue of the presence of the inorganic binder which, after polymerization, is a true cement, the compositions according to the invention exhibit a remarkable mechanical behavior, especially when they are in the form of tablets. It has been noted by the applicant, furthermore, that, despite the presence of the inorganic binder, the compositions according to the invention exhibit a burning rate which is entirely compatible with the standards imposed in respect of motor vehicle safety and which is even sometimes higher than the burning rate of equivalent binder-free conventional compositions.

Since the binder is wholly inorganic, it does not generate any toxic gas during the combustion of the composition according to the invention and, after combustion, the compositions according to the invention exhibit a mass of pulverulent residues which is much smaller than the equivalent binder-free conventional compositions because the polymerized binder does not break up and functions as an internal first filter during the combustion. In a pyrotechnic generator of gases for an inflatable bag, therefore, the compositions according to the invention require fewer filters and enable the weight of the generator to be reduced.

Finally, the presence of the polymerized inorganic binder provides the azide with partial protection against moisture.

The compositions according to the invention are therefore very suitable for making up the charge of a pyrotechnic generator of nontoxic cold gases, intended to inflate a safety bag for the occupants of a motor vehicle. The compositions according to the invention make it possible, in particular, to make up in this case charges in the form of tablets which exhibit an excellent storability with time.

The invention also relates to a process for the manufacture of the compositions according to the invention. This process consists, after having mixed the various constituents of the composition and having converted them into the form of use of the composition, tablets, blocks or other forms, in ensuring, in a first stage, the polymerization of the said binder and, in a separate second stage, the drying of the composition.

The constituents of the solid compositions according to the invention are of two kinds: on the one hand the conventional constituents such as the azide and the inorganic oxidizing agents, which are pulverulent solids, and, on the other hand, the inorganic binder which, before polymerization, is in liquid form and in most cases is marketed in the form of two separate solutions. Thus, the preferred binders of the invention are generally marketed in the form of an aqueous silicoaluminate solution and of an aqueous solution of colloidal silica in sodium hydroxide and/or potassium hydroxide, whose pH is generally close to 14. The pulverulent constituents are mixed in a solid mixer, whereas the unpolymerized inorganic binder is prepared by mixing its constituent solutions. It should be noted that the unpolymerized binder thus prepared does not react at room temperature and can be stored in the liquid state. The unpolymerized inorganic binder and the mixture of pulverulent solids are then introduced into a mixer and all the constituents of the composition are mixed by rotating the mixer. During the mixing stage the mixer will be generally cooled to prevent any heating of the constituents of the composition and any onset of polymerization of the inorganic binder.

At the end of the mixing operation the mixture of the constituents of the composition is converted into the desired form for the final composition: generally tablets, blocks or granules. At this stage it is appropriate to distinguish various types of mixtures as a function of the content of unpolymerized liquid binder in the mixture.

Mixtures in which the weight of unpolymerized binder is lower than or equal to 15% of the total weight of the constituents of the composition have the consistency of very slightly moist flour. These mixtures can be formed by making tablets, even though they have a slight tendency to form lumps. They can also be formed by compression in a mould to form a block.

Mixtures in which the weight of unpolymerized binder is between 15 and 25% of the total weight of the constituents of the composition are very difficult to process on an industrial scale by making tablets, but still lend themselves well to compression in a mould to form a block.

Mixtures in which the weight of unpolymerized binder is higher than 25% of the total weight of the constituents of the composition have the consistency of a pourable dough. They lend themselves well to the extrusion-injection technique for granulation.

In some cases it will also be advantageous, with a view to promoting contact between the pulverulent solid constituents and the unpolymerized liquid binder, to introduce a surface-active agent into the mixture.

The applicant's preferred surface-active agents are phosphorus-containing organotitanates.

After forming of the constituents of the composition, the polymerization of the inorganic binder is ensured in a first stage by heating the constituents. The rate of polymerization increases with the heating temperature but, bearing in mind the special nature of the other constituents of the composition, the latter cannot be raised too much. The applicant has found that heating to 60° C. for 24 hours enables a complete polymerization to be ensured without hazards. Since the polymerization reaction involves the participation of water molecules, it is important not to lose water by evaporation during the polymerization. Thus, the applicant recommends that the polymerization be performed in a leakproof closed vessel.

It has been noted experimentally that water does not degrade the azide during this polymerization stage because of the highly basic pH of the medium, even despite the heating operation which accompanies the polymerization. Such easy processability was not predictable and it gives an additional advantage to the process according to the invention.

At the end of the polymerization stage, drying of the composition is carried out in a second stage by removing the excess water. This drying is advantageously performed by heating in a ventilated vessel, at normal pressure or at reduced pressure. A simple solution consists in keeping the composition in the polymerization vessel whose doors are opened and in maintaining the heating at 60° C. for a new period of 24 hours.

Compositions according to the invention are then available ready for use.

The examples which follow illustrate some possibilities of making use of the invention, without limiting its scope.

EXAMPLE 1

This example is given by way of comparison. It relates to a conventional composition, without binder, based on sodium azide, potassium nitrate and silica in the following proportions:

| | |
|---|---|
| $NaN_3$: | 56 parts by weight |
| $KNO_3$: | 17 parts by weight |
| $SiO_2$: | 27 parts by weight |

This composition was converted, by tablet-making operation, into cylinders of dimensions:

| | |
|---|---|
| maximum height: | 15 mm |
| diameter: | 15 mm |
| weight: | 4.62 g |

Their tensile strength, measured on an instrument of "Erweka" ® trademark, was higher than 147N (15 kgf) and their elasticity 2%. The resistance of these cylinders to crumbling was measured according to the so-called "squirrel cage" test. To do this, 14 g of this composition were taken in the form of cylinders and were rotated in a cylindrical cage approximately 1200 $cm^3$ in capacity (cage diameter: 20 cm, cage length: 4 cm). The inner wall of the cage carries vanes.

After 4 hours' rotation in this so-called "squirrel" cage, the proportion of dust obtained, which is a function of the mechanical strength of the composition, is measured.

Under these conditions, approximately 30% of dust was obtained.

These cylinders were fired in a 27-$cm^3$ pressure bomb and gave the following results:

| | |
|---|---|
| energy output: | 0.204 MJ/kg |
| burning rate: | 16.7 mm/s at 7 MPa |

The effect of moisture on the mechanical properties of this composition was also studied.

To do this, the cylinders of composition were placed for 4 hours in a closed desiccator with 100% relative humidity in a ventilated oven at 60° C. Their tensile strength, which is virtually nil, was then measured.

EXAMPLE 2

A composition according to the invention was manufactured from the following constituents:

| | |
|---|---|
| $NaN_3$: | 69 parts by weight |
| $KNO_3$: | 21 parts by weight |
| binder: | 10 parts by weight |
| surface-active agent: | 0.1 part by weight |

The binder employed is marketed by the French company "Geopolymère" under the name "GP 70" and consists of two base solutions:

solution A: aqueous solution of colloidal silica in a mixture of sodium hydroxide and potassium hydroxide, solution B: aqueous solution of aluminosilicate ($Si_2O_5.Al_2O_2$).

To obtain the binder, 3.48 parts by weight of solution B were mixed with 6.52 parts by weight of solution A.

The surface-active agent employed was a phosphorus-containing organotitanate marketed by Kenrich Petrochemicals under the name "LICA 12".

The azide/nitrate powder mixture wa prepared in a solids mixer of "Turbula" type. Its preparation lasted one hour.

The unpolymerized liquid binder was introduced into a mixture maintained at 20° C. and, after starting up, the powder mixture was added in successive fractions. The total mixing time was one hour.

The mixture of the constituents which was thus obtained was formed into cylinders by compression.

The actual polymerization was carried out in a closed vessel heated to 60° C. for 24 hours. The drying was performed in a ventilated oven, heated to 60° C., for 24 hours.

Cylinders which had the following characteristics were thus obtained:

| | |
|---|---|
| height: | 15 mm |
| diameter: | 15 mm |
| weight: | 4.91 g |

The tensile strength of these cylinders was higher than 147N and their elasticity was 4.1%.

The so-called "squirrel cage" test, performed under the same conditions as those of Example 1, resulted in a dust content of only approximately 3%.

These cylinders were fired in a 27-cm$^3$ pressure bomb and gave the following results:

| | |
|---|---|
| energy output: | 0.29 MJ/kg |
| burning rate: | 17.2 mm/s at 7 MPa |

Analysis of the unfiltered combustion gases gave a nitrogen percentage higher than 99%, a carbon monoxide CO content lower than 120 ppm and a nitrogen oxide ($NO+NO_2$) content lower than 0.5 ppm.

These cylinders were also subjected to a moisture resistance test similar to that of Example 1. The tensile strength of these cylinders after a moisture test analogous with Example 1 was 104N (10.6 kgf).

Comparison between examples 1 and 2 shows that a composition according to the invention exhibits a mechanical strength and a moisture behavior which are superior when compared with a conventional composition of the same kind.

EXAMPLE 3

The procedure was as in Example 2, starting with the following constituents:

| | |
|---|---|
| $NaN_3$: | 53.5 parts by weight |
| $KNO_3$: | 16.3 parts by weight |
| binder: | 30 parts by weight |
| surface-active agent: | 0.2 parts by weight |

The binder was obtained by mixing 13.4 parts by weight of solution B with 16.6 parts by weight of solution A.

The surface-active agent was the same as that employed in unit 2.

Cylinders which had the following characteristics were obtained by casting:

| | |
|---|---|
| height: | 15 mm |
| diameter: | 15 mm |
| weight: | 4.9 g |

These cylinders were fired in a 27-cm$^3$ pressure bomb and gave the following results:

| | |
|---|---|
| energy output: | 0.23 MJ/kg |
| burning rate: | 12.1 mm/s at 7 MPa. |

EXAMPLE 4

The procedure was as in Example 3, starting with the following constituents:

| | |
|---|---|
| $NaN_3$: | 53.5 parts by weight |
| $KNO_3$: | 16.3 parts by weight |
| binder: | 30 parts by weight |

The binder was obtained by mixing 10.4 parts by weight of solution B with 19.6 parts by weight of solution A.

No surface-active agent was employed in this example.

Cylinders which had the following characteristics were thus obtained by casting:

| | |
|---|---|
| height: | 15 mm |
| diameter: | 15 mm |
| weight: | 4.9 g |

These cylinders were fired in a 27-cm$^3$ pressure bomb and gave the following results:

| | |
|---|---|
| energy output: | 0.23 MJ/kg |
| burning rate: | 10.2 mm/s at 7 MPa. |

EXAMPLE 5

The procedure was as in Example 3, starting with the following constituents:

| | |
|---|---|
| $NaN_3$: | 53.5 parts by weight |
| $KNO_3$: | 16.2 parts by weight |
| binder: | 30 parts by weight |
| surface-active agent: | 0.3 parts by weight |

The binder was obtained by mixing 10.4 parts by weight of solution B with 19.6 parts by weight of solution A.

The surface-active agent was the same as that employed in Example 2.

Cylinders which had the following characteristics were thus obtained by casting:

| | |
|---|---|
| height: | 15 mm |
| diameter: | 12.5 mm |
| weight: | 2.73 g |

These cylinders were fired in a 27-cm$^3$ pressure bomb and gave the following results:

| | |
|---|---|
| energy output: | 0.24 MJ/kg |
| burning rate: | 18.9 mm/s at 7 MPa. |

I claim:

1. A solid, non-toxic gas generating pyrotechnic composition consisting essentially of a mixture of:

(i) at least one alkali metal azide or an alkaline earth metal azide, and (ii) an inorganic oxidizing agent selected from the group consisting of an alkali metal nitrate, an alkaline earth metal nitrate, an alkali metal perchlorate, an alkaline earth metal perchlorate, a metal oxide, a metal sulfide and sulfur, and as a binder or cement for said mixture of (i) and (ii), between 5 and 40 percent by weight, relative to the total weight of said composition, of an inorganic product resulting from the polymerization of a mixture of oxides of silicon and of aluminum and (b) one or both of aqueous sodium hydroxide and aqueous potassium hydroxide in the presence of said mixture of (i) and (ii).

2. The composition of claim 1 wherein said binder is the polymerization product of a silicoaluminate having the formula ($Si_2O_5.Al_2O_2$), and silica $SiO_2$.

3. The composition of claim 1 wherein said binder is present in an amount ranging from 10 to 30 percent by weight, based on the total weight of said composition.

4. The composition of claim 1 wherein said inorganic oxidizing agent is an alkali metal nitrate or an alkaline earth metal nitrate.

5. The composition of claim 4 wherein said inorganic oxidizing agent is potassium nitrate.

6. The composition of claim 1 wherein said alkali metal azide is sodium azide.

* * * * *